United States Patent [19]

Nonaka

[11] 3,964,192

[45] June 22, 1976

[54] REFERENCE INDEXING DEVICE

[76] Inventor: Tsutomu Nonaka, 1-30-16-703, Hongoh, Bunkyo, Tokyo, Japan

[22] Filed: Dec. 27, 1974

[21] Appl. No.: 536,980

[30] Foreign Application Priority Data

Apr. 10, 1974 Japan ..... 49-40781

[52] U.S. Cl. ..... 40/104.01; 40/684

[51] Int. Cl.[2] ..... G09T 11/06

[58] Field of Search ..... 40/104.01, 68.4, 78.05, 40/67

[56] References Cited

UNITED STATES PATENTS

| | | | |
|---|---|---|---|
| 2,573,534 | 10/1951 | Bauer | 40/104.01 |
| 2,791,848 | 5/1957 | Neilsen | 40/104.01 |
| 2,849,815 | 9/1958 | Neilsen | 40/104.01 |
| 3,073,049 | 1/1963 | Levesque | 40/104.01 |

*Primary Examiner*—Hugh R. Chamblee
*Assistant Examiner*—John H. Wolff

[57] ABSTRACT

A reference indexing device which comprises a base box for supporting a stack of reference cards superimposed thereon, a selection means arranged at the head of the base box for selectively indexing a selected card from the stack of cards and a covering member operatively connected to the base box and having a hanger for picking up and retaining predetermined groups of cards above the selected card while leaving the selected card on the top of the stack of remaining cards on the base box for ready inspection by the operator.

4 Claims, 4 Drawing Figures

REFERENCE INDEXING DEVICE

BACKGROUND AND SUMMARY OF THE INVENTION

This invention relates to a device for indexing a specific card from the stack of the cards containing information such as telephone numbers, names, addresses and the like.

The indexing device of the type heretofore used usually utilizes a sliding mechanism which is relatively inconvenient in operation and some times follows erroneous indexing results.

The general object of the invention is, therefore, to provide a novel indexing device which is conveniently operable to obtain an accurate indexing result without any error.

In accordance with the indexing device of the present invention, an indexing operation is carried out by manually depressing one or more push buttons for selecting a particular card from the stack of cards superimposed on the base box of the device.

A principal object of the invention is to provide a card indexing device which comprises a base box for supporting a stack of reference cards superimposed thereon, a selection means arranged in the head room of the base box for selectively indexing one card from the stack of cards and a covering member operatively connected to the base box and having a hanger for lifting a group of cards above the selected card while leaving the selected card on the top of the stack on the base box for ready inspection by the operator.

The selection means comprises a lever arm pivoted to a cross shaft and having at its one end a push button and at its opposite end a plunger. The lever arm is resiliently carried by a support bar mounted in the head room of the base box.

The covering member at its rear side is pivotably connected to the rear end of the base box so that the covering member is opened in cooperation with the operation of selecting means. When the front side of the covering member is pivoted upwardly for opening, the card hanger provided inside of the covering member picks up the group of cards above the selected card from the stack of cards superimposed on the base box so that the selected card is left on the top of the stack remaining on the base box for ready inspection by the operator.

The invention will be more fully described hereinafter with reference to the accompanying drawings in which:

DETAILED DESCRIPTION OF THE PREFERRED EMBODIMENTS

Figure 1:
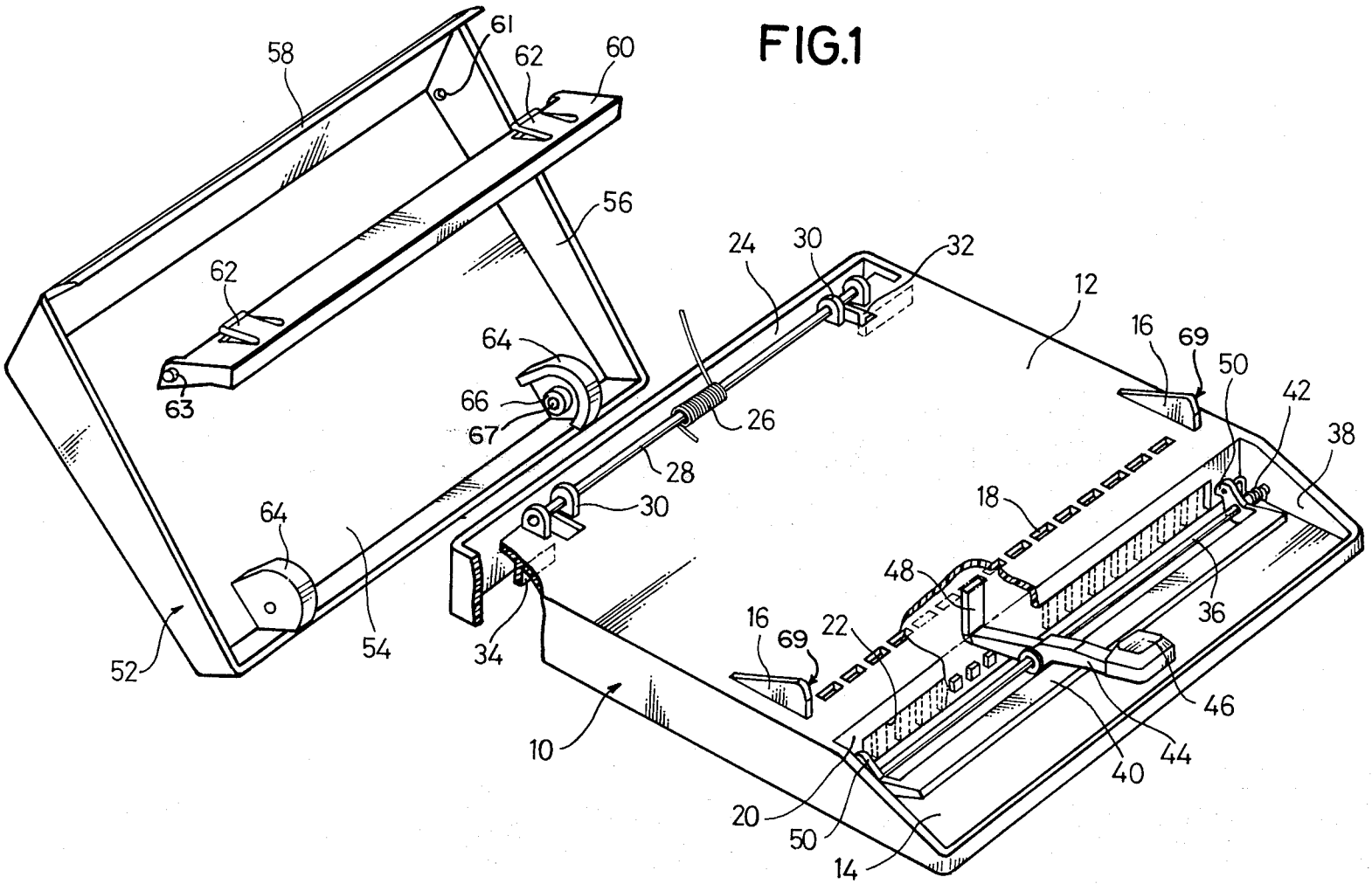
FIG. 1 is a perspective view of the indexing device of the present invention in disassembled position.

In FIG. 1, the base box comprises a substantially rectangular box 10 which includes a flat top or shelf 12 for supporting a stack of the reference cards and a head room 14 for accommodating a selection means.

On the flat top 12 at its opposide sides and near the head room 14 are disposed guide tabs 16, 16 for having a camming surface 69 at the forward portion thereof which coacts with the lip of a card hanger to be hereinafter described causing the hanger of the covering member to pick up the unselected cards from the stack of the cards as hereinafter fully described. On the flat top 12 and between the guide tabs 16, 16, there are provided a series of openings 18 through which a plunger of the selection means is operatively projected to lift the unselected cards.

Along a wall 20 partitioning the head room 14 from the base box 10 there are provided a series of windows 22 for receiving the lever arm of the selection means. It will be appreciated that these windows 22 may be replaced by a single slot when the selection means is comprised of only one sliding lever arm.

The box 10 along its rear end opposite to the front end thereof is provided with a slot 24 for receiving a rear rim of the covering member and in abutment with the slot 24 there is provided a spring 26 mounted around a rod 28 which is bridged between two pairs of support legs 30, 30. Between individual pair of the support legs 30, there is provided a recess 32 for receiving the card holder provided in the covering member as hereinafter fully described. Under the support legs 30 is provided a stopper 34 for suppressing the turning of the covering member under the influence of the spring 26 within a certain degree.

In front of the windows 22 a shaft 36 is bridged between opposite side walls 38, 38 and to the shaft 36 is resiliently mounted an elongated bar 40 with a pring 42 and pivoted a plurality of selection lever arms 44 having at its one end a push button 46 and at its opposite end a plunger 48.

The bar 40 has at its opposite ends hooks 50, 50 adapted to engage with a recess provided in a flange extending from the rim of the covering member as hereinafter described. By means of the spring 42 an outer part of the bar 40 is always urged upwardly.

Figure 4:
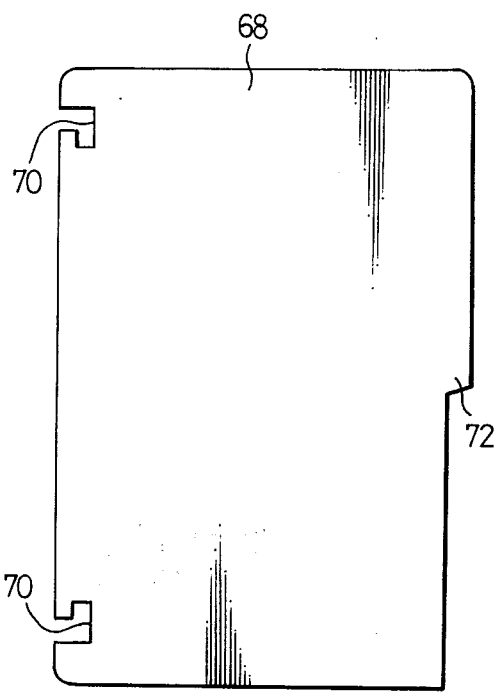
FIG. 4 is a plan view of a reference card to be used for the indexing device according to the invention.

The covering member 52 comprises a top cover plate 54 and a surrounding rim 56 which has a flange 58 at its front portion. Near the opposite ends of the flange 58, there are provided recesses 59, 59 adapted to engage with the hooks 50, 50 when the covering member 52 is closed. Within the covering member 52 and in abutment with the front rim thereof there is pivotably mounted within openings 61 in the forward portions of the side walls of the cover member pin elements 63 which project from opposite sides of a card hanger 60 of substantially L shape in section which is partially opened to form a pair of tongue pieces 62, 62 adapted to limit the turning motion of the hanger 60. The hanger 60, while the cover member is in its closed position, is thus wedged between the inner wall of the flange 58 and the camming surface of the guide tabs so that it cannot rotate. However, the spring force developed by engagement of the tongues with the front wall of the cover urges lip 65 against the camming surface of the guide tabs as the cover is lifted, the card hanger 60 being caused to rotate clockwise in openings 61 until the lip of the card hanger is positioned beneath the cards lifted by plunger 48. Continued upward movement of the cover results in a shifting of the support for the cards from the plunger to the lip 65 and the lifting of such cards together with the cover. Opposite to the hanger 60 there are provided a pair of the card holders 64, 64 having an ear structure with a center pole 66 having a central recess or opening 67 therein. The card holders 64, 64 are pivoted to the rod 28 and received in the recesses 32, 32 respectively as hereinbefore described. In FIG. 4, a card 68 intended for use with the indexing device in accordance with the present invention consists of a substantially rectangular card board which is provided at its one side with a pair of recesses 70 of substantially L shape adapted to be engaged with the card holder 64. The opposite side of the card 68 is recessed to provide an extended length portion 72. The length of extended portion 72 72 in each card is changed stepwisely for indexing purposes.

Figure 2:
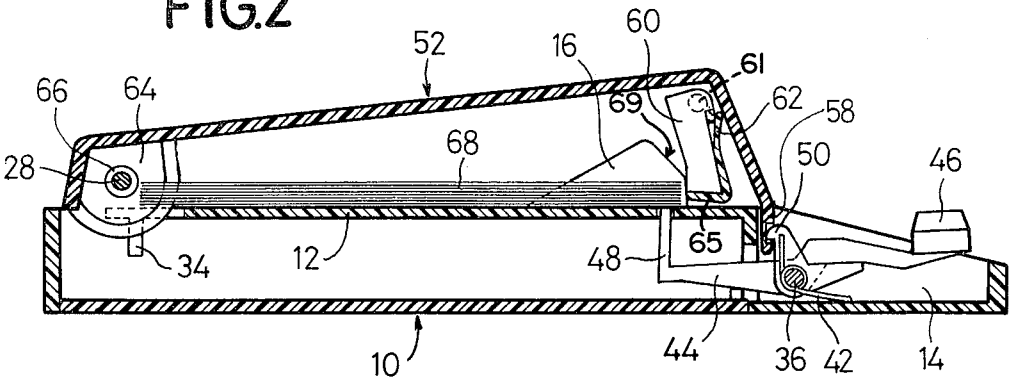
FIG. 2 is a longitudinally sectioned view of the indexing device in a closed position.
Figure 3:
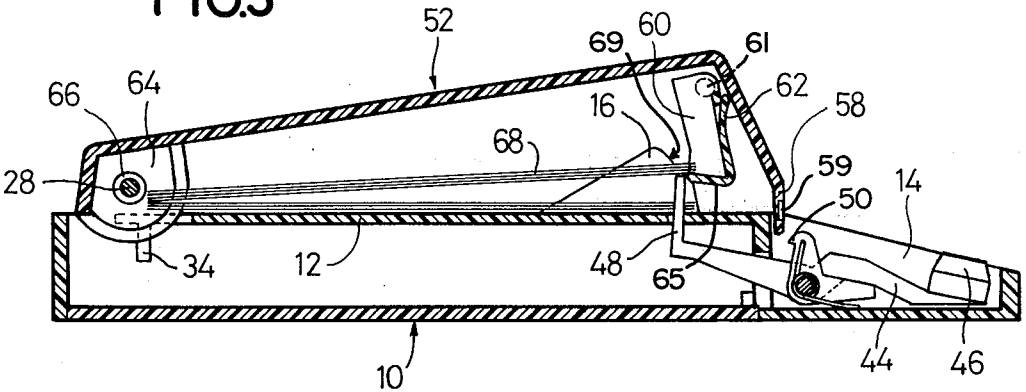
FIG. 3 is a sectional view similar to FIG. 2 but a portion of the stack of cards have been partially lifted by the operation of the selection means.

In the indexing operation of the device in the closed position as shown in FIG. 2, when the push button 46 at the selected position is depressed, the plunger 48 rises through the opening 18 to lift a predetermined group of unselected cards by engagement of plunger 48 with the lower surface of the lowermost of such cards, specifically the extended portion 72 thereof while the hooks 50, 50 are disengaged from the recesses 59, 59 as best shown in FIG. 3. As covering member 52 is pivoted upwardly into its open position the lip 65 of the hanger 60 slides along the inclined surface of the guide tab 16, which serves as the upper camming surface thereof, to pick up the group of unselected cards while leaving the selected card on the top of the stack of remaining cards for the inspection by the operator.

In accordance with the indexing device of the present invention, an accurate indexing result may be obtained by a simple pushing operation.

While the invention has been described with reference to a preferred embodiment of the invention, various changes and modifications may be made without, however, departing from the basic concepts as defined in the appended claims.

What I claim is:

1. In a card indexing device which includes a base member, means for supporting a stack of cards, at least one card selection lever arm pivotably mounted at the front portion of the base member and having a plunger at one end thereof positioned below the front portions of the cards and a push button at the other end thereof whereby actuation of the push button serves to pivot the plunger upwardly into engagement with the cards juxtaposed thereabove and lift such cards, a cover member pivotably connected at the rear end thereof to said base member and including a top wall and a depending front wall, means for biasing the card selection lever arm such that the push button is urged upwardly, means for releasably locking said cover member and base member, and means for applying an upwardly directed biasing force to said cover member tending to urge the cover member into an open position, the improvement comprising: at least one guide tab projecting upwardly from said card support means and having a forward camming surface including a lower vertical portion and an upper rearwardly and upwardly inclined portion; and a substantially L-shaped card hanger pivotably mounted in said cover member in close proximity to the front wall thereof, said card hanger including a generally vertically extending portion having at least one forwardly projecting tongue element struck from the material thereof and an inwardly directed lip portion at the lower extremity thereof, said at least one tongue element being cooperable with said front wall during the upward movement of the cover member to thereby urge said lip portion into camming engagement with the camming surfaces of said at least one guide tab to position the lip portion beneath the front portion of the cards lifted by said plunger for support of such cards during the continued upward movement of the cover member, said at least one tongue element being engageable with the front wall to limit the clockwise pivotal movement of the card hanger when the cover member is in a fully open position such that said lip portion is engageable with the camming surfaces of said at least one guide tab during downward movement of the cover member for guidance of the card hanger into a depending position in front of the stack of cards when the cover member is in its closed position.

2. A card indexing device according to claim 1, wherein said means for biasing said at least one card selection lever arm includes a shaft, a bar resiliently mounted on said shaft, a spring adapted to bias said bar, and said at least one card selection lever arm being mounted on said shaft.

3. A card indexing device according to claim 2, wherein said cover and base member locking means includes at least one recess formed in said front wall and cooperable corresponding hooks elements on said bar adapted to seat therewithin upon closure of the cover member, said hook elements being withdrawable from the corresponding recesses upon actuation of one of said push buttons and the consequent pivotal movement of said bar.

4. A card indexing device according to claim 1, including a pair of said guide tabs positioned in spaced relation and a pair of tongues positioned in spaced relation.

* * * * *